US012703888B2

(12) United States Patent
Momono et al.

(10) Patent No.: US 12,703,888 B2
(45) Date of Patent: Aug. 11, 2026

(54) METHOD FOR MANUFACTURING AUSTENITIC STAINLESS STEEL STRIP

(71) Applicant: Proterial, Ltd., Tokyo (JP)

(72) Inventors: Shogo Momono, Tokyo (JP); Shinichiro Fukada, Tokyo (JP); Toshihiro Uehara, Tokyo (JP)

(73) Assignee: Proterial, Ltd., Tokyo (JP)

( * ) Notice: Subject to any disclaimer, the term of this patent is extended or adjusted under 35 U.S.C. 154(b) by 433 days.

(21) Appl. No.: 18/265,967

(22) PCT Filed: Jun. 17, 2021

(86) PCT No.: PCT/JP2021/023106

§ 371 (c)(1),
(2) Date: Jun. 8, 2023

(87) PCT Pub. No.: WO2022/123812

PCT Pub. Date: Jun. 16, 2022

(65) Prior Publication Data

US 2024/0043948 A1 Feb. 8, 2024

(30) Foreign Application Priority Data

Dec. 10, 2020 (JP) ..... 2020-205135

(51) Int. Cl.
*C21D 8/0221* (2026.01)
*C21D 8/02* (2026.01)
(Continued)

(52) U.S. Cl.
CPC ..... *C21D 8/0226* (2013.01); *C21D 8/02* (2013.01); *C21D 8/0236* (2013.01);
(Continued)

(58) Field of Classification Search
CPC .. C21D 8/0226; C21D 8/0205; C21D 8/0236; C21D 8/0247; C21D 8/0278; C21D 9/52;
(Continued)

(56) References Cited

U.S. PATENT DOCUMENTS 5,045,124 A * 9/1991 Suehiro ..... C21D 8/0205 148/542
7,744,813 B2 6/2010 Brady et al.
(Continued)

FOREIGN PATENT DOCUMENTS

CN 102317489 1/2012
CN 108474072 8/2018
(Continued)

OTHER PUBLICATIONS

WO-2020067444-A1, machine translation. (Year: 2020).*
(Continued)

*Primary Examiner* — John A Hevey
(74) *Attorney, Agent, or Firm* — JCIPRNET

(57) ABSTRACT

A method for manufacturing an austenitic stainless steel strip comprises: hot-rolling a material having a component composition containing, in % by mass, more than 20.0% and 30.0% or less of Ni, more than 15.0% and 18.0% or less of Cr, 1.0 to 2.0% of Mo, 3.5% or more and less than 5.0% of Al, more than 1.0% and 2.0% or less of Nb+Ta, 0.3% or less of Ti+V, 1.0% or less of Si, 2.0% or less of Mn, 0.01 to 0.3% of Zr, 0.005 to 0.045% of C, 0.001 to 0.03% of B, and also containing at least one element selected from Y, La, Ce and Hf in an amount such that the content of Y+La+Ce+Hf+Zr can become 0.01 to 0.5% with the remainder comprising Fe and unavoidable impurities; cold-rolling the strip; and heating the strip, then maintaining the strip at that temperature, and rapid-cooling the strip.

1 Claim, 2 Drawing Sheets

(51) Int. Cl.

| | |
|---|---|
| ***C21D 8/0247*** | (2026.01) |
| ***C21D 8/0278*** | (2026.01) |
| ***C21D 9/52*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C21D 8/0247* (2013.01); *C21D 8/0278* (2013.01); *C21D 9/52* (2013.01); *C22C 38/005* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01)

(58) Field of Classification Search
CPC ..... C21D 2211/001; C21D 1/26; C21D 1/76; C21D 6/004; C21D 8/0273; C21D 9/46; C22C 38/005; C22C 38/02; C22C 38/06; C22C 38/44; C22C 38/46; C22C 38/48; C22C 38/50; C22C 38/54; C22C 38/58; C22C 38/04; C22C 30/00; C22C 38/52
See application file for complete search history.

(56) References Cited

U.S. PATENT DOCUMENTS

| | | | | |
|---|---|---|---|---|
| 7,754,144 | B2 | 7/2010 | Brady et al. | |
| 7,754,305 | B2 | 7/2010 | Yamamoto et al. | |
| 2008/0163957 | A1 | 7/2008 | Brady et al. | |
| 2014/0020797 | A1 | 1/2014 | Brady et al. | |
| 2018/0237882 | A1* | 8/2018 | Unno | B21B 1/22 |
| 2019/0010565 | A1* | 1/2019 | Kochi | C22C 38/06 |
| 2019/0112694 | A1* | 4/2019 | Takagi | C22C 38/46 |

FOREIGN PATENT DOCUMENTS

| | | | | |
|---|---|---|---|---|
| CN | 109415786 | | 3/2019 | |
| CN | 109642291 | | 4/2019 | |
| EP | 3401415 | | 11/2018 | |
| JP | H06271992 | | 9/1994 | |
| JP | H10140296 | | 5/1998 | |
| JP | 2004269986 | | 9/2004 | |
| JP | 2017066470 | | 4/2017 | |
| JP | 2017088945 | | 5/2017 | |
| JP | 2017179561 | | 10/2017 | |
| KR | 1020180095640 | | 8/2018 | |
| KR | 101895695 | | 9/2018 | |
| WO | 2017006843 | | 1/2017 | |
| WO | 2020067444 | | 4/2020 | |
| WO | WO-2020067444 | A1 * | 4/2020 | C22C 38/00 |

OTHER PUBLICATIONS

"Office Action of Korea Counterpart Application", issued on Jan. 27, 2025, with English translation thereof, p. 1-p. 9.
"International Search Report (Form PCT/ISA/210) of PCT/JP2021/023106", mailed on Aug. 31, 2021, with English translation thereof, pp. 1-5.
"Office Action of Taiwan Counterpart Application", issued on Jan. 18, 2022, with English translation thereof, pp. 1-9.
Teruo; Fujita, "Heat treatment of stainless steel", China Machine Press, Aug. 1983, with English translation thereof, pp. 1-5.
"Office Action of China Counterpart Application", issued on Jul. 11, 2025, with English translation thereof, p. 1-p. 14.
"Office Action of Germany Counterpart Application", with English translation thereof, issued on Sep. 30, 2025, pp. 1-14.

* cited by examiner

METHOD FOR MANUFACTURING AUSTENITIC STAINLESS STEEL STRIP

CROSS-REFERENCE TO RELATED APPLICATION

This application is a 371 application of the International PCT application serial no. PCT/JP2021/023106, filed on Jun. 17, 2021, which claims the priority benefits of Japan Patent Application No. 2020-205135, filed on Dec. 10, 2020. The entirety of each of the above-mentioned patent applications is hereby incorporated by reference herein and made a part of this specification.

TECHNICAL FIELD

The present invention relates to a method for manufacturing an austenitic stainless steel strip.

BACKGROUND ART

An austenitic stainless steel is mainly composed of Fe, Cr, and Ni and has an austenitic structure that is stable from low temperatures to high temperatures, and thus it is used in various applications that require corrosion resistance, high temperature strength and the like. When it is used at high temperatures, not only high temperature strength but also oxidation resistance in an oxidizing atmosphere are required. A general austenitic stainless steel contains about 16% or more of Cr and exhibits oxidation resistance by forming a protective Cr oxide film composed of $Cr_2O_3$ on the surface in an oxidizing atmosphere at high temperatures up to about 700° C.

On the other hand, since an Al oxide film is more stable than a Cr oxide film at higher temperature, for example, an austenitic stainless steel that exhibits more satisfactory oxidation resistance by containing 2% or more of Al and forming a protective Al oxide film composed of $Al_2O_3$ on the surface of a steel material has been proposed. For example, Patent Literature 1 discloses an austenitic stainless steel having high Nb, Ta, and Al creep strength and satisfactory oxidation resistance. In addition, Patent Literature 2 discloses an Al-containing austenitic stainless steel having oxidation resistance and high creep strength. In addition, Patent Literature 3 discloses a high-Mn Al-containing austenitic stainless steel. In addition, regarding a manufacturing method, Non-Patent Literature 1 discloses that an experimental melt (500 g) of an alumina-forming austenitic stainless steel is heated and maintained at 1,200 to 1,250° C. for 0.5 to 2 hours, water cooling is then performed and thus the crystal grain size is controlled to be 40 to 340 μm. In addition, Non-Patent Literature 2 discloses that an experimental melt (12.7×12.7×76.2 mm) is heated at 1,200° C. in order to control the crystal grain size of hot-rolled or cold-rolled alumina-forming austenitic stainless steel at 1,150° C. to be 20 to 50 μm. In addition, Non-Patent Literature 3 discloses that 15 kg of an alumina-forming austenitic stainless steel experimental material prepared by vacuum melting is heated in a natural gas atmosphere at 1,093° C. for 4 hours and then hot-forged, heated in a natural gas atmosphere at 1,093° C. for 1.5 hours and then hot-rolled, additionally maintained at 1,200° C. for 0.25 to 0.5 hours and then water-cooled to obtain a nominal crystal grain size of 50 μm.

CITATION LIST

Patent Literature

[Patent Literature 1]
U.S. Pat. No. 7,754,144

[Patent Literature 2]
U.S. Pat. No. 7,744,813
[Patent Literature 3]
U.S. Pat. No. 7,754,305

Non-Patent Literature

[Non-Patent Literature 1]
Oxidation of Metals (2009) 72, p. 311-333
[Non-Patent Literature 2]
Metallurgical Transactions A 38A (2007) p. 2737-2746
[Non-Patent Literature 3]
Materials Science and Engineering A 590 (2014) p. 101-115

SUMMARY OF INVENTION

Technical Problem

In the above Non-Patent Literature 1 to 3, the manufacturing method and the crystal grain size obtained by the method are described, but the final heat treatment temperature at which the crystal grain size is determined is 1,200° C. or higher. The crystal grain size is a structural factor that greatly affects the creep strength, and it is necessary to increase the crystal grain size in order to obtain high creep strength, and thus it is thought that the final heat treatment temperature of the austenitic stainless steel disclosed in Non-Patent Literature 1 to 3 needs to be 1,200° C. or higher. However, manufacture through the final heat treatment at temperatures of 1,200° C. or higher may be limited or difficult in steel strip mass production facilities. In addition, Patent Literature 1 to 3 describe the chemical components and structure of high Al austenitic stainless steel having various chemical components, but there is no description of the manufacturing method. It is thought that there is a close causal relationship between the chemical components, the structure, the properties, and the manufacturing method, but the optimal manufacturing method for austenitic stainless steel having respective chemical components is unknown and there is room for further improvement.

An objective of the present invention is to provide a method for manufacturing an austenitic stainless steel strip having properties equivalent to the creep strength and oxidation resistance of existing high Al austenitic stainless steel and including a final heat treatment condition at an industrially applicable low temperature.

Solution to Problem

The inventors conducted studies regarding chemical components of existing high Al austenitic stainless steel and a manufacturing method, and particularly, lowering the final heat treatment temperature, and as a result, found that, when a large amount of Cr and Al contributing to oxidation resistance is maintained and the amount of C is adjusted to be low, there is a final heat treatment temperature lower than 1,200° C. at which a large crystal grain size and high creep strength can be obtained, and completed the present invention.

Specifically, the present invention is a method for manufacturing an austenitic stainless steel strip and obtaining an austenitic stainless steel strip having a sheet width of 120 mm or more and a sheet thickness of 3 mm or less, including a hot rolling step of performing hot rolling on a hot rolling material having a component composition including, in % by mass, Ni: more than 20.0% and 30.0% or less, Cr: more than 15.0% and 18.0% or less, Mo: 1.0 to 2.0%, Al: 3.5% or more and less than 5.0%, Nb+Ta: more than 1.0% and 2.0% or less, Ti+V: 0.3% or less (including 0%), Si: 1.0% or less (including 0%), Mn: 2.0% or less (including 0%), Zr: 0.01 to 0.3%, C: 0.005 to 0.045%, B: 0.001 to 0.03%, and as necessary, at least one of Y, La, Ce, and Hf in a range of 0.01 to 0.5% of Y+La+Ce+Hf+Zr, with the remainder comprising Fe and unavoidable impurities, a cold rolling step of performing cold rolling on a hot-rolled steel strip after the hot rolling step, and a solution treatment step of performing heating and maintaining a cold-rolled steel strip after the cold rolling step in a non-oxidizing atmosphere substantially free of nitrogen at 1,000 to 1,150° C. for 0.1 to 30 minutes and then rapid cooling at a cooling rate of 5° C./s or faster.

Preferably, the average austenite grain size of the austenitic stainless steel strip is 30 to 100 μm.

Preferably, the method may further include a polishing step of removing an oxide layer and a nitride layer on the surface of the rolled steel strip between the hot rolling step and the cold rolling step or during the cold rolling step.

Advantageous Effects of Invention

According to the present invention, it is possible to significantly improve industrial scale manufacturability of an austenitic stainless steel having both high creep strength and satisfactory oxidation resistance.

Figure 2:
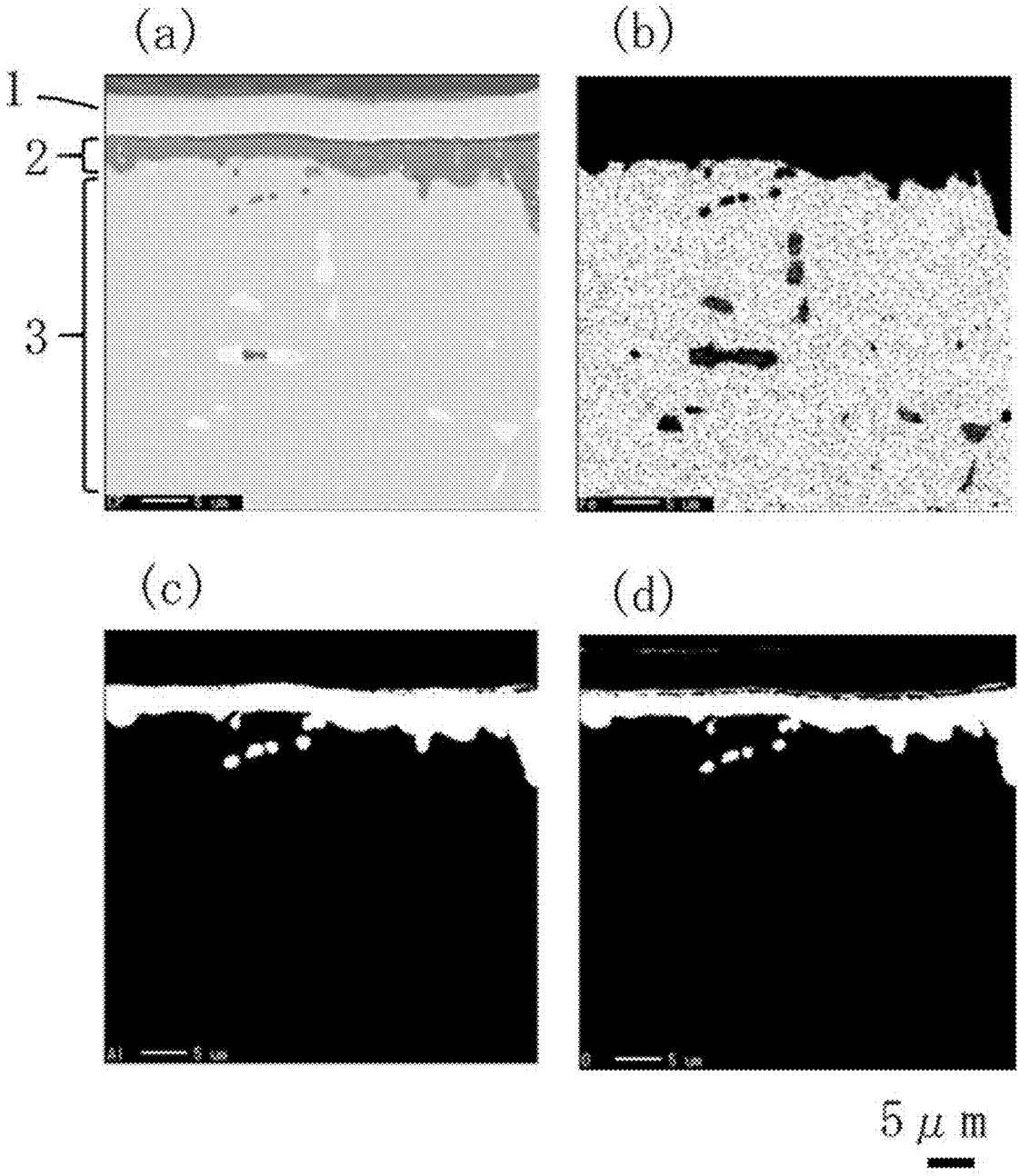

(a) of FIG. 2 is a reflection electron image of a cross section after an austenitic stainless steel strip of an example of the present invention is heated at 1,000° C. for 1,000 hours. (b) of FIG. 2 shows the surface analysis results of Fe by an electron beam microanalyzer. (c) of FIG. 2 shows the surface analysis results of Al by an electron beam microanalyzer. (d) of FIG. 2 shows the surface analysis results of O by an electron beam microanalyzer.

DESCRIPTION OF EMBODIMENTS

A method for manufacturing an austenitic stainless steel strip according to an embodiment of the present invention will be described. Here, the steel strip in the present invention also includes a steel sheet prepared by cutting the steel strip. First, in the present invention, a hot rolling material having a component composition shown below is prepared. For the hot rolling material, industrially applicable melting methods, for example, are melting in air, high-frequency induction melting and subsequent secondary out-of-furnace smelting or induction melting in a vacuum may be applied. The obtained ingot is preferably subjected to a homogenizing heat treatment at 1,150 to 1,200° C. for 1 to 100 hours to reduce segregation of components and used as a material for hot plastic processing. In addition, hot plastic processing is performed by hot blooming forging, hot blooming rolling or the like to obtain a hot rolling material.

Next, the reason for limiting components of a hot rolling material specified in the present invention will be described. Here, the content of each element is in % by mass.

<Ni: More than 20.0% and 30.0% or Less>

Ni is an important element that stabilizes an austenite phase which is a base structure in an austenitic stainless steel. In addition, it is an important element that improves high temperature strength by precipitating a fine intermetallic compound (NiAl) in an austenite phase of a base together with Al. Ni is added in consideration of a balance with the amount of Cr, which is an element that provides satisfactory corrosion resistance and oxidation resistance in an austenitic stainless steel. When used in the steel strip of the present invention, if the content of Ni is 20.0% or less, there is a risk of an austenite phase becoming unstable and a ferrite phase being formed, and on the other hand, if the content of Ni added is more than 30.0%, since an improving effect cannot be expected, and an increase in costs is caused, the content of Ni is set to more than 20.0% and 30.0% or less. The lower limit of Ni is preferably 23.0%, and the upper limit of Ni is preferably 27.0%. More preferably, the lower limit of Ni is 24.0% and the upper limit of Ni is 26.0%.

<Cr: More than 15.0% and 18.0% or Less>

Cr is an important element that contributes to corrosion resistance and oxidation resistance in an austenitic stainless steel. If the content of Cr is 15.0% or less, there is a risk of sufficient oxidation resistance not being obtained, and on the other hand, if the content of Cr added is more than 18.0%, since there is a risk of a ferrite phase or an a phase being formed and oxidation resistance and mechanical properties deteriorating, the content of Cr is set to more than 15.0% and 18.0% or less. The upper limit of Cr is preferably 17.0%, and the upper limit of Cr is more preferably 16.0%.

<Mo: 1.0 to 2.0%>

Mo is an element that is solid-solutionized in an austenite phase of a base in an austenitic stainless steel and improves mechanical properties and corrosion resistance. If the content of Mo is less than 1.0%, the effect of improving mechanical properties and corrosion resistance is weak, and on the other hand, if the content of Mo added is more than 2.0%, since there is a risk of a ferrite phase or an a phase being likely to be formed and mechanical properties, corrosion resistance, and oxidation resistance deteriorating, the content of Mo is set to 1.0 to 2.0%. The upper limit of Mo is preferably 1.5%.

<Al: 3.5% or More and Less than 5.0%>

Al is an element necessary for obtaining satisfactory oxidation resistance by preferentially forming a dense protective oxide film ($Al_2O_3$) on the surface of a steel strip in a high-temperature oxidizing atmosphere. In addition, it is an important element that finely precipitates as an intermetallic compound (NiAl) in an austenite phase of a base during use at a high temperature and improves high temperature strength. If the content of Al is less than 3.5%, since it is difficult to form a dense oxide film, there is a risk of oxidation resistance becoming insufficient, and on the other hand, if the content of Al added is 5.0% or more, since there is a possibility of a ferrite phase being likely to be formed, an intermetallic compound being excessively precipitated, and the plastic processability deteriorating, the content of Al is set to 3.5% or more and less than 5.0%. The lower limit of Al is preferably 4.0%. In addition, the upper limit of Al is preferably 4.5%.

<Nb+Ta: More than 1.0% and 2.0% or Less>

Nb is an important element that improves oxidation resistance and creep strength of a high Al austenitic stainless steel. Nb improves oxidation resistance by helping with formation of a dense Al oxide film formed on the surface of the steel strip and improves creep strength by precipitating $Fe_2Nb$, NbC and the like. Some or all of the Nb can be replaced with Ta. If the content of Nb+Ta is 1.0% or less, an effect of improving oxidation resistance and creep strength is weak, and on the other hand, if the content of Nb+Ta added is more than 2.0%, since there is a risk of a large amount of coarse precipitates such as $Fe_2Nb$ and NbC being precipitated and hot processability being impaired, the content of Nb+Ta is set to more than 1.0% and 2.0% or less. The lower limit of Nb+Ta is preferably 1.3%, and the upper limit of Nb+Ta is preferably 1.9%.

<Ti+V: 0.3% or Less (Including 0%)>

Like Nb and Ta, Ti and/or V are elements that improve creep strength by precipitating an MC-type carbide, and one or two of these elements can be contained. When a required amount of Nb and/or Ta is added, Ti and V are not necessarily required, and may not be added. On the other hand, if the content of Ti+V is more than 0.3%, since there is a risk of oxidation resistance and hot processability being impaired, the content of Ti+V is set to 0.3% or less (including 0%).

<Si: 1.0% or Less (Including 0%), Mn: 2.0% or Less (Including 0%)>

Si and Mn are added as deoxidizing elements, but do not necessarily need to be added when induction melting in a vacuum is applied, and may not be added. Even if the content of Si added is more than 1.0% and the content of Mn added is more than 2.0%, since there is no further effect, the content of Si is set to 1.0% or less (including 0%), and the content of Mn is set to 2.0% or less (including 0%).

<Zr: 0.01 to 0.3%>

Zr is an important element that improves adhesion of an Al oxide film formed on the surface of a steel strip made of an austenitic stainless steel, and thus improves oxidation resistance. If the content of Zr is less than 0.01%, a sufficient effect cannot be obtained, and on the other hand, if the content of Zr added is more than 0.3%, since not only is a further effect not obtained, but there is also a risk of the amount of an MC-type carbide containing Zr increasing and hot processability deteriorating, the content of Zr is set to 0.01 to 0.3%. The lower limit of Zr is preferably 0.03%, and the upper limit of Zr is preferably 0.2%.

<C: 0.005 to 0.045%>

C is an element that not only stabilizes an austenite phase which is a base structure but also improves creep strength by forming an MC-type carbide mainly together with Nb. If the content of C is less than 0.005%, a sufficient effect cannot be obtained, and on the other hand, if the content of C added is more than 0.045%, since not only is a large amount of a coarse MC-type carbide precipitated, deteriorating hot processability, but the final solution treatment temperature at which an MC-type carbide is solid-solutionized and the crystal grain size increases is also increased, it is difficult to perform a solution treatment at a general industrially applicable low temperature, the crystal grain size decreases, and the creep strength decreases, and thus the content of C is set to 0.005 to 0.045%. The lower limit of C is preferably 0.01%, and the upper limit of C is preferably 0.04%. The lower limit of C is more preferably 0.02%, and the upper limit of C is more preferably 0.035%.

<B: 0.001 to 0.03%>

B is an element that improves creep strength in an austenitic stainless steel by segregating at grain boundaries of austenite crystal grains and increasing grain boundary strength. If the content of B is less than 0.001%, a sufficient effect cannot be obtained, and on the other hand, if the content of B added is more than 0.03%, since it reacts with alloy elements to form a coarse boride and a grain boundary strengthening effect cannot be obtained, and in addition there is a risk of hot processability decreasing, the content of B is set to 0.001 to 0.03%. The lower limit of B is preferably 0.005%, and the upper limit of B is preferably 0.02%.

<At Least One of Y, La, Ce and Hf in a Range of 0.01 to 0.5% of Y+La+Ce+Hf+Zr>

Y, La, Ce, and Hf are elements that improve adhesion of an Al oxide film formed on the surface of a steel strip made of austenitic stainless steel, and thus improve oxidation resistance, and are added as necessary together with Zr. Since they are added together with Zr, Y+La+Ce+Hf+Zr may be defined. If the content of Y+La+Ce+Hf+Zr is less than 0.01%, a sufficient effect of improving oxidation resistance cannot be obtained, and on the other hand, if the content thereof added is more than 0.5%, since there is a risk of a large amount of inclusions such as oxides being formed and hot processability and cold processing deteriorating, the content of at least one of Y, La, Ce, and Hf is set to 0.01 to 0.5%, in terms of Y+La+Ce+Hf+Zr.

<Remainder: Fe and Unavoidable Impurities>

The remainder is Fe, which is a basic constituent element of an austenitic stainless steel, and also includes impurities. For example, W, Cu, N, P, S and the like do not have a particularly great detrimental effect as long as W: 1.0% or less, Cu: 0.5% or less, N: 0.03% or less, P: 0.040% or less, and S: 0.01% or less.

Next, the reason for limiting the manufacturing method will be described.

<Hot Rolling Step>

In the present invention, a step of hot-rolling a hot rolling material having the above components to obtain a hot-rolled steel strip is performed. Hot rolling is performed by heating a hot rolling material at a temperature at which hot processability can be secured and passing it through a hot rolling mill. In order to solid-solutionize and soften as much of a carbide composed of Nb, Al, Ni and the like and an intermetallic compound as possible and secure satisfactory hot processability, the hot rolling start temperature is preferably 1,100° C. or higher and more preferably 1,130° C. or higher. In addition, the upper limit of the hot rolling start temperature is preferably lower than 1,200° C. at which the grain boundary strength decreases significantly and cracks occur.

<Cold Rolling Step>

In order to further reduce the thickness, perform high-accuracy dimension adjustment and recrystallization in the subsequent solution treatment step, and apply cold processing strain required for crystal grain growth, the hot-rolled steel strip is subjected to cold rolling through a cold rolling mill, and a cold-rolled steel strip having a width of 120 mm or more and a thickness of 3 mm or less is obtained. The width of the cold-rolled steel strip is preferably 150 mm or more and the width is more preferably 200 mm or more. In addition, the thickness of the cold-rolled steel strip is preferably 2.8 mm or less, and the thickness is more preferably 2.6 mm or less. Before a cold rolling step, pickling may be performed in order to roughly remove a surface oxide layer and nitride layer formed during hot rolling. In addition, after the hot rolling step and/or during a plurality of cold rolling steps, annealing may be performed once or more times for softening the steel strip in order to obtain satisfactory cold rollability. Annealing is preferably performed in a non-oxidizing atmosphere gas substantially free of nitrogen in order to prevent an Al oxide layer and/or Al nitride layer from being formed on the surface of the rolled steel strip.

<Solution Treatment Step>

The solution treatment step is a step in which the cold-rolled steel strip after the cold rolling step is heated at a high temperature, rapid cooling is performed, solid-solutionizing of alloy elements is promoted, a relatively coarse crystal grain size required for obtaining high creep strength by recrystallization and crystal grain growth is obtained, and the steel strip is softened so that part molding processing and welding can be easily performed, and is a necessary and important step as the final heat treatment step for this steel strip. The solution treatment atmosphere is a non-oxidizing atmosphere substantially free of nitrogen in order to prevent an oxide layer and/or nitride layer to be formed on the surface of the steel strip due to oxidation. The atmospheric gas is preferably, for example, a reducing gas or an inert gas such as hydrogen gas or argon gas. When a steel strip having this component is used, since it is possible to coarsen and adjust the crystal grain size by recrystallization and crystal grain growth at a low temperature, it is possible to perform a solution treatment in a low temperature range in which a heat treatment can be performed in a general manufacturing facility. If the heating temperature in the solution treatment is lower than 1,000° C., solid-solutionizing of alloy elements become insufficient, carbides and intermetallic compounds remain, since not only does the hardness not decrease sufficiently, but also recrystallization and crystal grain growth become insufficient, a desired coarse crystal grain size cannot be obtained and on the other hand, if the heating temperature is higher than 1,150° C., since there is a risk of a crystal grain size becoming too coarse and tensile ductility and impact toughness decreasing, the solution treatment temperature is set to 1,000 to 1,150° C. The lower limit temperature of the solution treatment is preferably 1,050° C. In addition, the upper limit temperature of the solution treatment is preferably 1,130° C. A continuous furnace is often used for the solution treatment of the cold-rolled steel strip, and the heating and maintaining time is a relatively short time. The heating and maintaining time tends to be short when the sheet thickness is thin and tends to be long when the sheet thickness is thick, and the degree of solid-solutionizing of alloy elements, the degree of hardness decrease, the degree of crystal grain size growth or the like may be determined as an indicator. If the heating and maintaining time is shorter than 0.1 minutes, a sufficient effect cannot be obtained, and on the other hand, if the heating and maintaining time is longer than 30 minutes, it is difficult to obtain a further effect, and thus the heating and maintaining time is set to 0.1 to 30 minutes. The upper limit of the heating and maintaining time is preferably 10 minutes. In addition, due to facility restrictions, when a desired structure cannot be obtained by a single solution treatment, a solution treatment may be repeated a plurality of times. Cooling after the solution treatment is rapid cooling because there is a need to maintain a solid solution state. The cooling method is not particularly limited, and water cooling, oil cooling, air cooling or the like can be used. If the cooling rate is slower than 5° C./s (second), since there is a risk of alloy elements that are solid-solutionized during cooling being re-precipitated, the hardness increasing, and oxidation resistance decreasing, the cooling rate is set to 5° C./s or faster. The cooling rate is preferably 7.5° C./s or faster.

The average austenite grain size of the austenitic stainless steel strip after the above solution treatment step greatly affects creep strength, and it is necessary to adjust the austenite grain size to be relatively coarse in order to obtain high creep strength. The crystal grain size can be controlled mainly according to the final solution treatment condition, and can be controlled within an appropriate range according to the above solution treatment condition in the case of the austenitic stainless steel strip of the present invention. If the average austenite grain size is smaller than 30 μm, sufficient creep strength cannot be obtained, and on the other hand, if the average austenite grain size is larger than 100 μm, since there is a risk of tensile ductility and impact toughness decreasing, the average austenite grain size is set to 30 to 100 μm. The lower limit of the average austenite grain size is preferably 40 μm. In addition, the upper limit of the average austenite grain size is preferably 80 μm.

<Polishing Step>

Since the austenitic stainless steel strip of the present invention contains a large amount of Al, an oxide layer composed of a dense Al oxide and/or a nitride layer composed of a needle-like Al nitride is likely to be formed on the surface of the steel strip according to a heat treatment in air, hot rolling or the like. While the Al oxide layer and the Al nitride layer remain on the surface of the steel strip, when cold processing is performed by cold rolling and the final solution treatment step is completed, since the non-uniform Al oxide layer and Al nitride layer remain on the surface of the steel strip of the final product, it tends to be difficult to obtain stable and satisfactory oxidation resistance. Therefore, it is preferable to remove the oxide layer and the nitride layer on the surface of the rolled material (steel strip). The removal method is not limited as long as the Al oxide layer and the Al nitride layer remaining on the surface of the rolled material can be completely removed. Since the Al oxide layer and the Al nitride layer are chemically stable, it is difficult to completely remove them by a chemical removal method, for example, pickling, and it is difficult to obtain a uniform metal surface texture, but this does not prevent application of a pickling step before cold rolling. On the other hand, according to a mechanical removal method, for example, polishing, a certain thickness can be removed, complete removal becomes easier, and thus a polishing step is preferably selected as a method of removing the oxide layer and the nitride layer on the surface of the rolled material to obtain metallic luster. The polishing step may be performed either between the hot rolling step and the cold rolling step or during the cold rolling step because it is sufficient that the oxide layer and the nitride layer on the surface of the rolled material be completely removed before the final solution heat treatment.

EXAMPLES

Using an ingot melted and cast by vacuum induction melting, a hot rolling material having a thickness of about 45 mm and a width of about 330 mm was prepared by a homogenizing heat treatment, hot forging, and hot rolling. Table 1 shows chemical components of the hot rolling materials. Here, No. 1 was a hot rolling material according to an example of the present invention, and No. 2 was a hot rolling material according to a comparative example. These hot rolling materials were heated at 1,150° C. and then hot-rolled to manufacture a hot-rolled steel strip having a thickness of 3 mm. Here, when the degree of scratches on the surface occurred in the hot forging and hot rolling step in the hot rolling materials No. 1 and No. 2 was checked, the occurrence of scratches on the surface could be reduced more in the hot rolling material No. 1 than No. 2, and hot processability was satisfactory. Then, during the cold rolling step, a polishing step of removing an Al oxide layer and an Al nitride layer on the surface of the steel strip was performed, and cold rolling and annealing were then repeated several times to manufacture cold-rolled steel strips having various thicknesses from 0.2 mm to 1.5 mm and a width of about 250 mm. In addition, the obtained cold-rolled steel strips were subjected to a solution treatment in which they were heated and maintained in a continuous furnace in a hydrogen atmosphere at 1,100° C. for about 1 to 5 minutes, and rapid cooling was then performed at a cooling rate of 5° C./s or faster to obtain an austenitic stainless steel strip No. 5 manufactured from the hot rolling material No. 1 according to an example of the present invention and an austenitic stainless steel strip No. 7 manufactured from the hot rolling material No. 2 according to a comparative example.

In addition, as conventional examples of a general austenitic stainless steel, hot-rolled materials melted and cast by vacuum induction melting and having a thickness of about 30 mm and a width of about 120 mm and having components shown in Table 2 were prepared. Here, No. 3 and No. 4 corresponded to NCF800 steel and NCF625 steel, respectively, described in JIS G 4902. These hot-rolled materials were heated at 1,100° C. and then hot-rolled repeatedly to manufacture a hot-rolled steel strip having a thickness of about 3.5 mm. Then, cold rolling and annealing were repeated to obtain a cold-rolled steel strip having a thickness of 1.5 mm and then subjected to a solution treatment in which it was heated and maintained in a vacuum atmosphere furnace at 1,150° C. for 30 minutes, and rapid cooling was then performed to obtain austenitic stainless steel strips No. 9 and No. 10.

TABLE 1

| (% by mass) | | | | | | | | | | | | | | |
|---|---|---|---|---|---|---|---|---|---|---|---|---|---|---|
| No. | C | Si | Mn | Ni | Cr | Mo | Al | Ti | V | Nb | Zr | B | Fe | Note |
| 1 | 0.03 | 0.15 | 1.01 | 25.61 | 15.47 | 1.25 | 4.08 | 0.003 | 0.01 | 1.66 | 0.07 | 0.013 | remainder | example of present invention |
| 2 | 0.10 | 0.24 | 1.03 | 25.16 | 15.51 | 1.99 | 4.36 | 0.002 | 0.02 | 1.74 | 0.12 | 0.011 | remainder | comparative example |

(Note)
impurity element P: 0.003 to 0.005%, S: 0.002%, W: <0.01%, Cu: <0.01%, N: 0.004 to 0.006%

TABLE 2

| (% by mass) | | | | | | | | | | | |
|---|---|---|---|---|---|---|---|---|---|---|---|
| No. | C | Si | Mn | Ni | Cr | Mo | Al | Ti | Nb | Fe | Note |
| 3 | 0.02 | 0.30 | 0.74 | 30.88 | 20.31 | — | 0.23 | 0.310 | — | remainder | conventional example |
| 4 | 0.07 | 0.30 | 0.26 | remainder | 21.42 | 8.90 | 0.35 | 0.370 | 3.58 | 3.48 | conventional example |

Note:
"—" indicates not added (impurity level)

A test piece (sample) was cut out from austenitic stainless steel strips No. 5 and No. 7 having a thickness of 1.5 mm, the average austenite grain size was measured by optical structure observation in a vertical cross section, and a tensile test in the rolling direction at room temperature and 850° C., a creep rupture test in the rolling direction at 800, 850, and 900° C. and an oxidation resistance test at 1,000° C. were performed. In addition, a test piece cut out from a cold-rolled steel strip having a thickness of 1.5 mm was subjected to a solution treatment in which it was heated and maintained in a hydrogen atmosphere at 1,150° C. for 5 minutes and then air-cooled and rapid cooling was performed at a cooling rate of 5° C./s or faster to obtain a sample No. 6 manufactured from the hot rolling material No. 1 according to an example of the present invention and a sample No. 8 manufactured from the hot rolling material No. 2 according to a comparative example. Like No. 5 and No. 7, these were subjected to measurement of the average austenite grain size by optical structure observant ion in a vertical cross section, a tensile test in the rolling direction at room temperature and 850° C., a creep rupture test in the rolling direction at 800, 850, and 900° C., and an oxidation resistance test at 1,000° C. For the austenitic stainless steel strips No. 9 and No. 10 having a thickness of 1.5 mm, a test piece (sample) was indexed, and only an oxidation resistance test at 1,000° C. was performed. Table 3 shows the average austenite grain size, Table 4 shows the tensile test results, Table 5 shows creep rupture test results and Table 6 shows the oxidation resistance test results.

Based on Table 3, samples according to examples of the present invention had an average austenite grain size of about 50 μm, which as an optimal coarse grain, even if the solution treatment temperature was either 1,100 or 1,150° C., but samples according to comparative examples had finer grains having an average austenite grain size finer than 30 μm when the solution treatment temperature was 1,100° C. or 1,150° C. In this manner, according to the manufacturing method of the present invention, it was possible to obtain an appropriate average austenite grain size at which high creep strength was easily exhibited. In addition, based on Table 4, in the samples according to examples of the present invention, even if the solution treatment temperature was either 1,100 or 1,150° C., compared to the samples according to comparative examples, the 0.2% yield strength and tensile strength at room temperature were lower, but the 0.2% yield strength and tensile strength at 850° C. which was a high temperature environment, were equivalent. In addition, based on Table 5, it was found that, in the samples according to examples of the present invention, even if the solution treatment temperature was either 1,100° C. or 1,150° C., compared to the samples according to comparative examples, the creep rupture time was long and the creep strength was high. The reason why the creep strength of the steel strip manufactured using the hot rolling material of the present invention by the present invention method was high is that the average austenite grain size was controlled to be coarse, and the creep breaking strength could be increased even when a solution treatment was performed at a relatively low temperature of 1,100° C. or 1,150° C.

TABLE 3

| No. | Solution treatment temperature (° C.) | Average austenite grain size (μm) | Note |
|---|---|---|---|
| 5 | 1100 | 49.5 | example of present invention |
| 6 | 1150 | 52.9 | example of present invention |
| 7 | 1100 | 14.9 | comparative example |
| 8 | 1150 | 25.4 | comparative example |

TABLE 4

| No. | Solution treatment temperature (° C.) | 0.2% yield strength (room temperature) (MPa) | Tensile strength (room temperature) (MPa) | Elongation (room temperature) (%) | 0.2% yield strength (850° C.) (MPa) | Tensile strength (850° C.) (MPa) | Elongation (850° C.) (%) | Note |
|---|---|---|---|---|---|---|---|---|
| 5 | 1100 | 271 | 644 | 54.9 | 177 | 180 | 53.8 | example of present invention |
| 6 | 1150 | 228 | 630 | 57.2 | 189 | 190 | 83.2 | example of present invention |
| 7 | 1100 | 320 | 734 | 44.5 | 179 | 180 | 48.4 | comparative example |
| 8 | 1150 | 273 | 698 | 48.0 | 191 | 193 | 73.3 | comparative example |

TABLE 5

| No. | Solution treatment temperature (° C.) | Creep rupture time (800° C.-70 MPa) (h) | Creep rupture time (850° C.-50 MPa) (h) | Creep rupture time (900° C.-30 MPa) (h) | Note |
|---|---|---|---|---|---|
| 5 | 1100 | 260.0 | 199.2 | 397.6 | example of present invention |
| 6 | 1150 | 168.7 | 138.2 | 304.4 | example of present invention |
| 7 | 1100 | 89.7 | 69.5 | 116.6 | comparative example |
| 8 | 1150 | 111.1 | 124.1 | 272.7 | comparative example |

Figure 1:
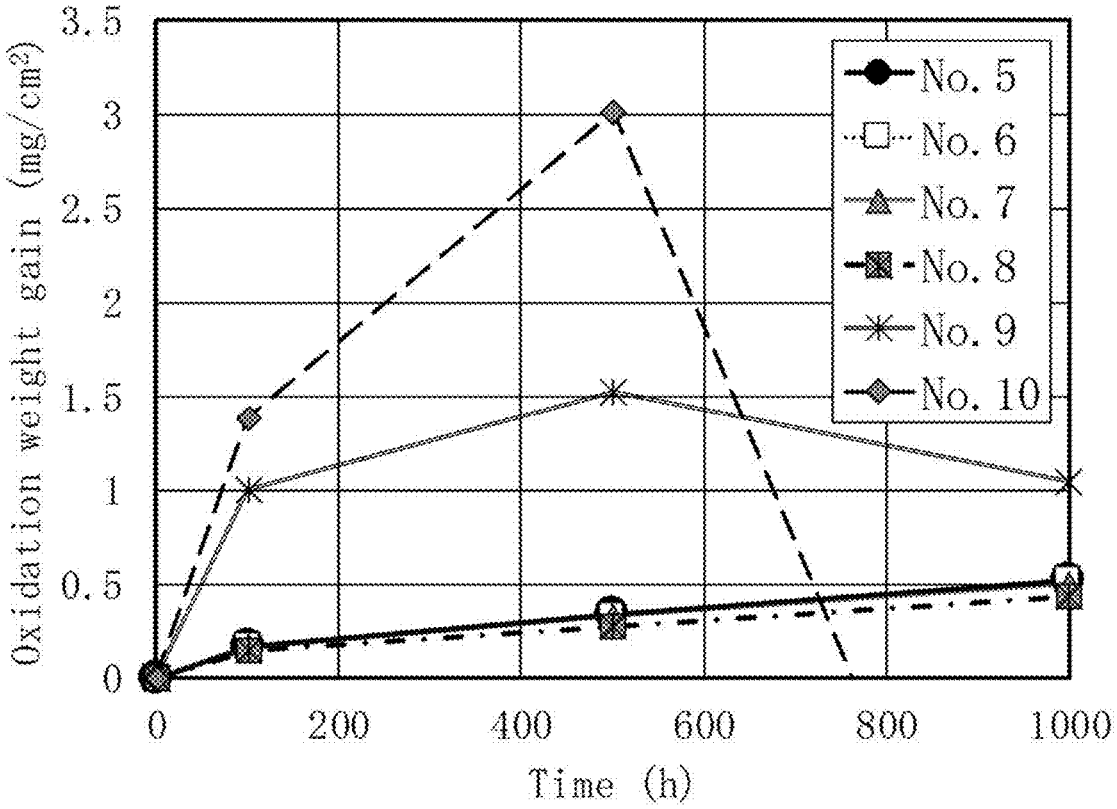
FIG. 1 is a graph showing the weight gain due to oxidation obtained when austenitic stainless steel strips of examples of the present invention and comparative examples are heated at 1,000° C. for 1,000 hours.

In the oxidation resistance test, the surfaces of the test pieces Nos. 5 to 10 (samples) having dimensions of 15 mm (w)×15 mm (l)×1.5 mm (t) were polished using sandpaper to #1000. Then, in air, the polished test pieces were heated at 1,000° C. for 100 to 1,000 hours, and the weight before and after oxidation was measured. The results are shown in Table 6. In the samples No. 9, and No. 10 according to conventional examples, which were general austenitic stainless steel that forms a Cr oxide film, the weight gain due to oxidation was large up to 500 hours. In addition, in the sample No. 10, the oxide film was peeled off due to thermal stress during cooling after heating for 1,000 hours, and the weight gain due to oxidation decreased. Such peeling off of the oxide film should be avoided in order to promote oxidation of the metal base. On the other hand, in the examples of the present invention which were high Al austenitic stainless steel and samples No. 7 and No. 8 according to comparative examples, it was confirmed that the weight gain due to oxidation up to 1,000 hours was small and oxidation resistance was satisfactory. In addition, in FIG. 1, it was confirmed that the weight gain of the test pieces Nos. 5 to 8 due to oxidation followed the parabolic law, there was no peeling off of the oxide film, and oxidation behavior was stable.

The test piece No. 5 after heating for 1,000 hours was subjected to Ni plating, and surface analysis of Fe, Al, and O was performed on the metal base and the oxide film using an electronic microanalyzer. The obtained pictures are shown in (a) to (d) of FIG. 2. (a) of FIG. 2 is a picture showing a reflection electron image of a cross section of the sample, and (b) of FIG. 2 to (d) of FIG. 2 are pictures showing surface analysis results of Fe, Al, and O in the same observation area as in (a) of FIG. 2. As a result obtained by comparing the reflection electron image with surface analysis of respective elements, it was confirmed that, in the samples according to examples of the present invention, a protective Al oxide film composed of $Al_2O_3$ was formed.

As described above, since the austenitic stainless steel strip obtained by the manufacturing method of the present invention had both high creep strength and satisfactory oxidation resistance, it could be expected to improve reliability of parts of devices used at high temperatures such as heat treatment furnaces, heat exchangers, and solid oxide fuel cells.

TABLE 6

| No. | Solution treatment temperature (° C.) | Weight gain due to oxidation after heating for 100 hours (mg/cm$^2$) | Weight gain due to oxidation after heating for 500 hours (mg/cm$^2$) | Weight gain due to oxidation after heating for 1,000 hours (mg/cm$^2$) | Note |
|---|---|---|---|---|---|
| 5 | 1100 | 0.17 | 0.34 | 0.52 | example of present invention |
| 6 | 1150 | 0.17 | 0.33 | 0.52 | example of present invention |
| 7 | 1100 | 0.16 | 0.33 | 0.50 | comparative example |
| 8 | 1150 | 0.14 | 0.27 | 0.43 | comparative example |
| 9 | 1150 | 1.00 | 1.52 | 1.04 | conventional example |
| 10 | 1150 | 1.38 | 3.01 | −2.74 | conventional example |

What is claimed is:

1. A method for manufacturing an austenitic stainless steel strip, which obtains an austenitic stainless steel strip having a sheet width of 120 mm or more and a sheet thickness of 3 mm or less, the method comprising:

a hot rolling step of performing hot rolling on a hot rolling material to form a hot-rolled steel strip, wherein the hot rolling material has a component composition including, in % by mass, Ni: more than 20.0% and 30.0% or less, Cr: more than 15.0% and 18.0% or less, Mo: 1.0 to 2.0%, Al: 3.5% or more and less than 5.0%, Nb+Ta: more than 1.0% and 2.0% or less, Ti+V: 0.3% or less, including 0%, Si: 1.0% or less, including 0%, Mn: 2.0% or less, including 0%, Zr: 0.01 to 0.3%, C: 0.005 to 0.045%, B: 0.001 to 0.03%, and as necessary, at least one of Y, La, Ce, and Hf in a range of 0.01 to 0.5% of Y+La+Ce+Hf+Zr, with the remainder comprising Fe and unavoidable impurities;

a cold rolling step of performing cold rolling on the hot-rolled steel strip after the hot rolling step to form a cold-rolled steel strip;

a polishing step of removing an oxide layer and a nitride layer formed during the hot rolling step on a rolled steel strip surface between the hot rolling step and the cold rolling step or during the cold rolling step; and a solution treatment step of performing heating and maintaining the cold-rolled steel strip after the cold rolling step in a non-oxidizing atmosphere free of nitrogen at 1,000 to 1,150° C. for 0.1 to 30 minutes and then rapid cooling at a cooling rate of 5° C./s or faster, wherein the austenitic stainless steel strip obtained after the solution treatment step has an average austenite grain size of 30 to 100 μm.

* * * * *